US009909246B2

(12) United States Patent
Kim et al.

(10) Patent No.: US 9,909,246 B2
(45) Date of Patent: Mar. 6, 2018

(54) WASHING METHOD

(71) Applicant: LG ELECTRONICS INC., Seoul (KR)

(72) Inventors: Kyounglan Kim, Seoul (KR); Youngsoo Kim, Seoul (KR); Daekil In, Seoul (KR)

(73) Assignee: LG Electronics Inc., Seoul (KR)

( * ) Notice: Subject to any disclaimer, the term of this patent is extended or adjusted under 35 U.S.C. 154(b) by 96 days.

(21) Appl. No.: 14/691,846

(22) Filed: Apr. 21, 2015

(65) Prior Publication Data

US 2015/0299926 A1 Oct. 22, 2015

(30) Foreign Application Priority Data

Apr. 21, 2014 (KR) ..... 10-2014-0047650

(51) Int. Cl.

*D06F 35/00* (2006.01)
*D06F 21/02* (2006.01)
*D06F 39/00* (2006.01)

(52) U.S. Cl.

CPC ..... *D06F 35/006* (2013.01); *D06F 21/02* (2013.01); *D06F 35/005* (2013.01); *D06F 39/003* (2013.01); *D06F 2202/10* (2013.01)

(58) Field of Classification Search

CPC ..... D06F 35/005; D06F 35/006; D06F 21/02; D06F 39/003; D06F 2202/10

See application file for complete search history.

(56) References Cited

U.S. PATENT DOCUMENTS 3,194,398 A * 7/1965 Fecho ..... D06F 35/00 210/138
2008/0256722 A1* 10/2008 Oberkirsch ..... D06F 35/006 8/159
2010/0205753 A1* 8/2010 Kim ..... D06F 39/083 8/137
2011/0099727 A1* 5/2011 Kim ..... D06F 35/006 8/137
2011/0185515 A1* 8/2011 Sans Rovira ..... D06F 35/006 8/137
2012/0180534 A1 7/2012 Cho et al.
2012/0297554 A1 11/2012 McAllister et al.

FOREIGN PATENT DOCUMENTS

CN 101407991 12/2010
CN 102482824 5/2012
EP 0 742 307 11/1996
EP 1 983 088 A1 10/2008
EP 2 287 378 A1 2/2011

OTHER PUBLICATIONS

European Search Report dated Aug. 20, 2015 issued in Application No. 15164023.2.
Chinese Office Action dated Sep. 28, 2016 issued in Application No. 201510190901.6 (with English translation).

* cited by examiner

*Primary Examiner* — Joseph L Perrin
(74) *Attorney, Agent, or Firm* — KED & Associates LLP

(57) ABSTRACT

A washing method includes (a) continuously rotating a drum in one direction at a first speed such that laundry is lifted to a predetermined height and then falls, (b) accelerating the drum to rotate the drum at a second speed such that the laundry is moved in a state in which at least some of the laundry clings to the drum, and (c) spraying wash water into the drum during rotation of the drum at the second speed.

12 Claims, 8 Drawing Sheets

WASHING METHOD

CROSS-REFERENCE TO RELATED APPLICATION

This application claims priority under 35 U.S.C. § 119 to Korean Patent Application No. 10-2014-0047650, filed on Apr. 21, 2014 in the Korean Intellectual Property Office, whose entire disclosure is hereby incorporated by reference.

BACKGROUND

1. Field

The present disclosure relates to a washing method.

2. Background

In general, a laundry treatment apparatus is an apparatus that performs a washing process, a rinsing process, a spin-drying process, etc. for removing contaminants from clothing, bedding, etc. (hereinafter, referred to as 'laundry') using water, detergent, and a mechanical action. The laundry treatment apparatus is mainly classified as an agitator type laundry treatment apparatus, a pulsator type laundry treatment apparatus, or a drum type laundry treatment apparatus.

In the agitator type laundry treatment apparatus, a washing rod vertically disposed at the center of a washing tub is rotated in alternating directions to wash laundry. In the pulsator type laundry treatment apparatus, a circular rotary blade formed at the bottom of a washing tub is rotated in alternating directions to wash laundry using frictional force between a stream of water and the laundry. In the drum type laundry treatment apparatus, a drum is rotated in a state in which water, detergent, and laundry is received in the drum to wash the laundry.

In the drum type laundry treatment apparatus, a tub for receiving wash water is mounted in a cabinet forming the external appearance of the drum type laundry treatment apparatus, a drum for receiving laundry is disposed inside the tub, a motor for rotating the drum is mounted at the rear of the tub, and a drive shaft is coupled to the motor such that the drive shaft is connected to the rear of the drum through the tub. A plurality of lifters is mounted at the inside of the drum for lifting the laundry during rotation of the drum.

In the drum type laundry treatment apparatus, however, a degree in which the laundry is wetted by the wash water is changed depending upon weight of the laundry placed in the drum. As a result, it is not possible to achieve uniform washing performance. Particularly in a case in which a large amount of laundry is placed in the drum, the change in position of the laundry in the drum is not smoothly made, whereby it is not possible to uniformly wet the laundry.

BRIEF DESCRIPTION OF THE DRAWINGS

The embodiments will be described in detail with reference to the following drawings in which like reference numerals refer to like elements wherein.

DETAILED DESCRIPTION

Figure 1:
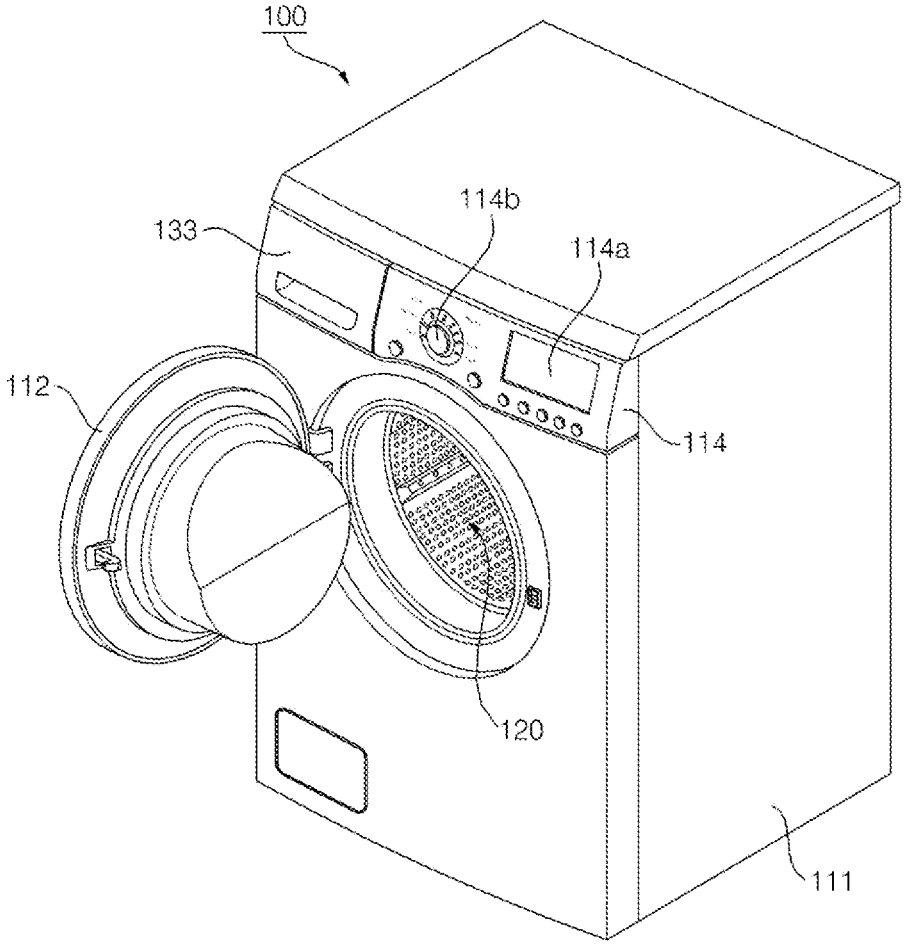
FIG. 1 is a perspective view showing a laundry treatment apparatus according to an embodiment of the present disclosure.
Figure 2:
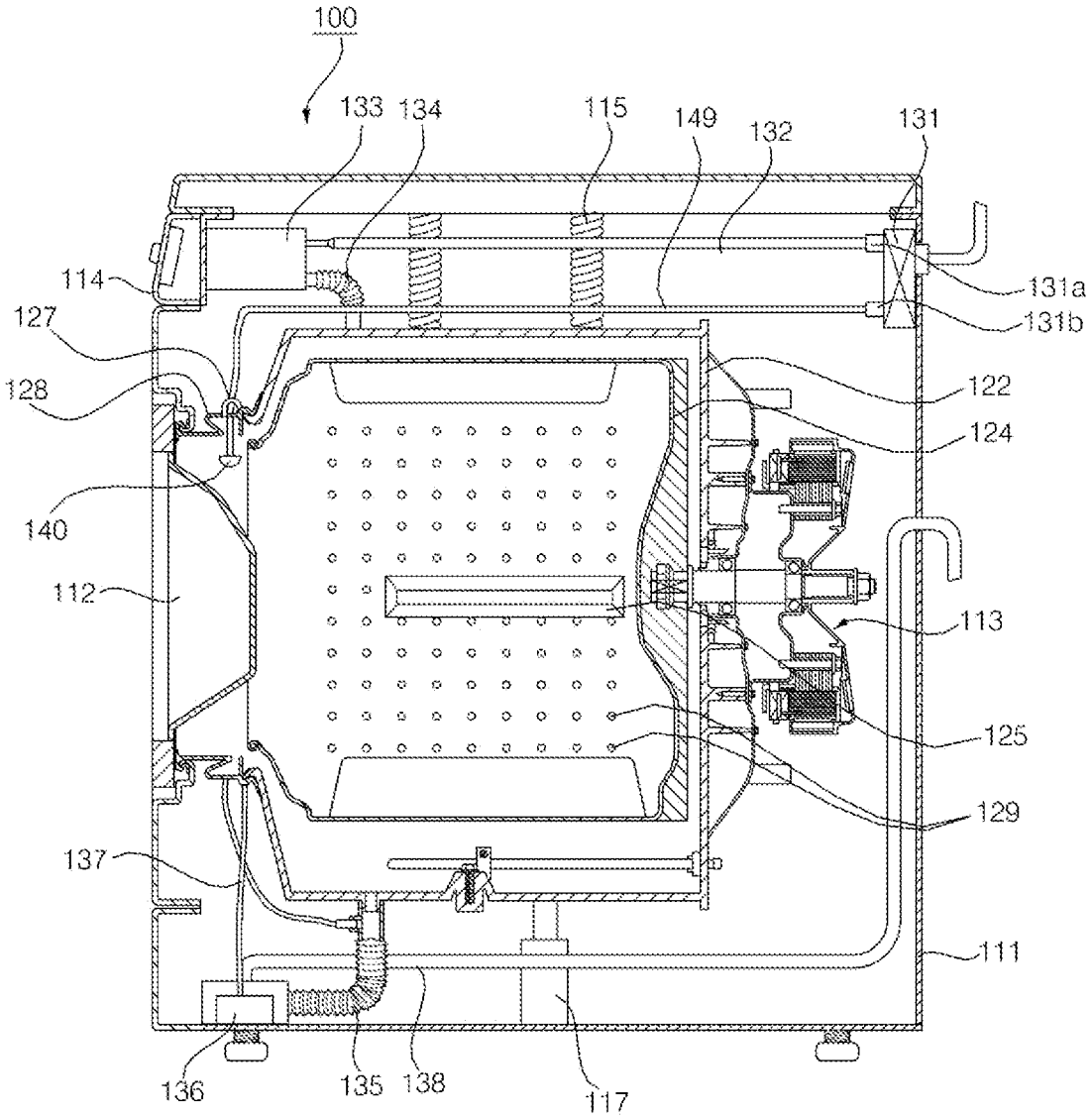
FIG. 2 is a sectional view showing the laundry treatment apparatus of FIG. 1.
Figure 3:
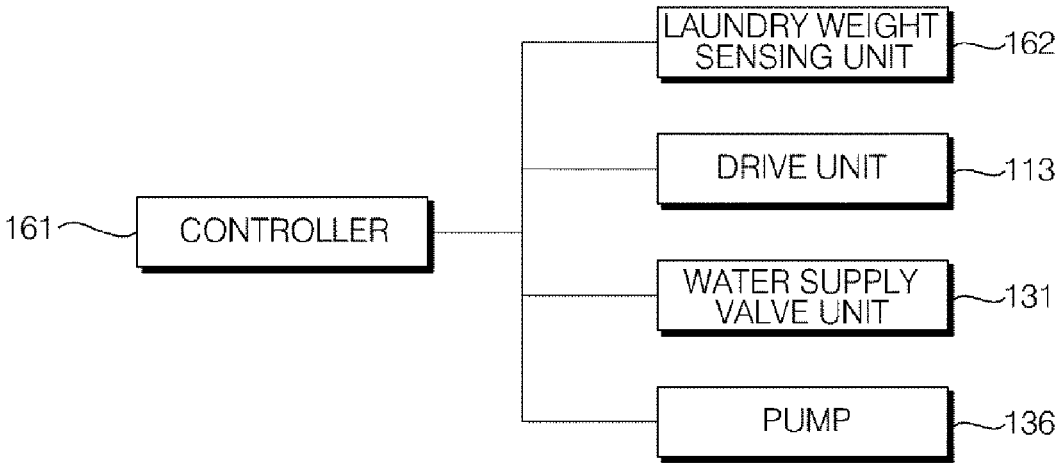
FIG. 3 is a block diagram showing a control relation among main components of the laundry treatment apparatus of FIG. 1.
Figure 4:
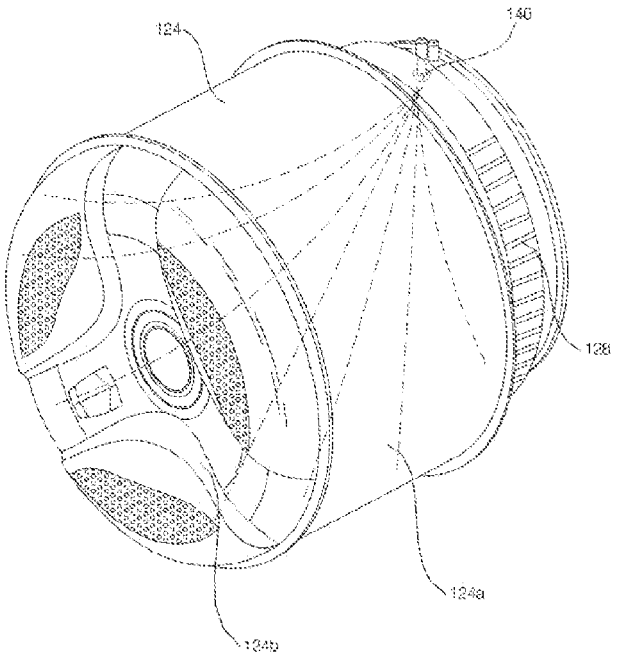
FIG. 4 is a view showing that wash water is sprayed into a drum through a spray nozzle according to an embodiment of the present disclosure.

FIG. 1 is a perspective view showing a laundry treatment apparatus 100 according to an embodiment of the present disclosure, and FIG. 2 is a sectional view showing the laundry treatment apparatus 100 of FIG. 1. FIG. 3 is a block diagram showing a control relation among main components of the laundry treatment apparatus 100 of FIG. 1, and FIG. 4 is a view showing that wash water is sprayed into a drum 124 through a spray nozzle 140 according to an embodiment of the present disclosure.

The laundry treatment apparatus 100 includes a cabinet 111 forming the external appearance of the laundry treatment apparatus 100, a drum 124 provided in the cabinet 111, the drum 124 being rotated in a state in which laundry is placed in the drum 124, a tub 122 provided in the cabinet 111 for receiving the drum 124, a gasket 128 provided between the cabinet 111 and the tub 122, and a spray nozzle 140 for atomizing wash water and spraying the atomized wash water into the drum 124. The spray nozzle 140 may be provided at the upper part of the gasket 128.

The laundry treatment apparatus 100 further includes a door 112 provided at the front of the cabinet 111 for opening and closing a laundry introduction and removal hole 120 through which laundry is introduced into and removed from the cabinet 111. A drive unit or assembly 113 rotates the drum 124, and a detergent box 133 is configured to receive detergent. The drive unit 113 is configured to rotate the drum 124. The drive unit 113 may rotate the drum 124 at various speeds or in various directions. The drive unit 113 may include a motor, a switching device for controlling the motor, and a clutch. A control panel 114 is configured to receive a command from the user and display a state of the laundry treatment apparatus 100.

The laundry introduction and removal hole or opening 120 is formed at the cabinet 111 such that laundry can be introduced or placed into and removed from the cabinet 111. The door 112 is hinged and mounted at the front of the cabinet 111 to allow opening and closing the laundry introduction and removal hole 120. The control panel 114 is provided at the cabinet 111 for allowing the user to input a command and displaying various kinds of state information of the laundry treatment apparatus 100. The detergent box, in which detergent, such as a washing detergent, a fabric softener, or a bleaching agent, is received, is separately mounted in the cabinet 111.

The tub 122 is provided in the cabinet 111 such that the tub 122 is suspended by springs 115 and a damper 117. The tub 122 receives wash water. The drum 124 is disposed in the tub 122. The drum 124 is rotated in a state when laundry is placed in the drum 124 for washing. The drum 124 is provided with a plurality of through holes 129 through which wash water passes. The drum 124 may be provided at the inner wall thereof with a plurality of lifters 125 for lifting the laundry to a predetermined height during rotation of the drum 124. Rotational force from the drive unit 113 is transmitted to the drum 124 such that the drum 124 can be rotated.

The gasket 128 is provided between the tub 122 and the cabinet 111 for achieving sealing between the tub 122 and the cabinet 111. The gasket 128 is disposed between the entrance of the tub 122 and the laundry introduction and removal hole 120. The gasket 128 eliminates shock transmitted to the door 122 during rotation of the drum 124 and prevents leakage of wash water from the tub 122. The gasket 128 may be provided with a circulation nozzle 127 and a spray nozzle 140 to introduce wash water into the drum 124.

The gasket 128 may be made of a single material. In order to achieve high fastening strength between the gasket 128 and the tub 122 and sufficient rigidity of the gasket 128 a portion of the gasket 128 fastened to the tub 122 is made of a rigid material. A portion of the gasket 128 fastened to the cabinet 111 may be made of an elastic material for eliminating vibration transmitted from the tub 122 to the cabinet 111.

Detergent, such as a washing detergent, a fabric softener, or a bleaching agent, is provided into the detergent box 133. The detergent box 133 may be separately provided at the front of the cabinet 111. During supply of wash water, the detergent in the detergent box 133 is mixed with the wash water, and the mixture is introduced into the tub 122. The detergent box 133 may be partitioned into a washing detergent receiving unit or region in which the washing detergent is received, a fabric softener receiving unit or region in which the fabric softener is received, and a bleaching agent receiving unit or region in which the bleaching agent is received.

A water supply valve 131 is configured to control introduction and amount of wash water from an external water source, a first water supply hose 132, via which the wash water introduced through the water supply valve 131 is supplied to the detergent box 133 by a first water supply valve 131*a*, and a water supply pipe 134 via which the wash water mixed with the detergent in the detergent box 133 is introduced into the tub 122.

The water supply valve 131 is provided with a second water supply valve 131*b* and a second water supply hose 149, which are connected to the spray nozzle 140. The first water supply valve 131*a* and the second water supply valve 131*b* open the first water supply hose 132 and the second water supply hose 149, which are connected to the first water supply valve 131*a* and the second water supply valve 131*b*, respectively. Wash water introduced into the water supply valve 131 from the external water source can be supplied to the first water supply hose 132 and the second water supply hose 149.

A drainage pipe 135 is configured to drain wash water from the tub 122, and a pump 136 is configured to pump the wash water from the tub 122 for drainage. A circulation channel 137 circulates the wash water drained from the tub 122, and a circulation nozzle 127 introduces the wash water into the drum 124. A drainage channel 138 is configured to drain wash water to the outside. The pump 136 may include a circulation pump and a drainage pump, which may be connected to the circulation channel 137 and the drainage channel 138, respectively.

The control panel 114 may be provided with an input unit or interface 114*b* for allowing a user to select a washing course or to input various operation commands, such as operation time per cycle and schedule. A display panel 114*a* is configured to display an operation state of the laundry treatment apparatus 100.

The spray nozzle 140 is provided at the upper part of the gasket 128. When the door 112 closes the laundry introduction and removal hole 120, a portion of the door 112 protrudes into the drum 124. The spray nozzle 140 is located such that the spray nozzle 140 does not interfere with the portion of the door 112 protruding into the drum 124. When the door 112 closes the laundry introduction and removal hole 120, the spray nozzle 140 is spaced apart from the door 112 by a predetermined distance. The spray nozzle 140 sprays wash water to an inside surface 124*a* and a rear surface 124*b* of the drum 124.

The circulation nozzle 127 is provided at the gasket 128 for circulating wash water in the drum 124. Wash water received in the drum 124 flows to the pump 136 via the drainage pipe 135 provided at the tub 122. The pump 136 feeds the wash water to the circulation nozzle 127 via the circulation channel 137. The wash water is resupplied into the drum 124 through the circulation nozzle 127. The circulation nozzle 127 is fluid connected with the circulation channel 137 which extends upwardly from the pump, but the connection between the circulation channel 137 and the circulation nozzle is not shown in FIG. 2 but it is fully clear to those skilled in the art.

The spray nozzle 140 is provided adjacent to the circulation nozzle 127. The spray nozzle 140 is located at the upper part of the gasket 128, at which the circulation nozzle 127 is also located such that the spray nozzle 140 can be driven together with the circulation nozzle 127 or alone during operation of the laundry treatment apparatus 100. According to embodiments, the spray nozzle 140 may be integrally formed with the circulation nozzle 127. However, the present disclosure is not limited thereto.

The water supply valve 131 supplies wash water from the external water source into the drum 124. The first water supply valve 131*a* and the second water supply valve 131*b* are provided at the water supply valve 131. The first water supply valve 131*a* and the second water supply valve 131*b* are controlled by a controller 161. The controller 161 controls the first water supply valve 131*a* and the second water supply valve 131*b* such that wash water can be supplied to the first water supply hose 132 and the second water supply hose 149, which are connected to the first water supply valve 131*a* and the second water supply valve 131*b*, respectively.

The water supply valve 131 may include a hot water valve (not shown), a bleach valve (not shown), a pre-action valve (not shown), a main valve (not shown), and a steam valve (not shown), which are connected to the detergent box 133. The hot water valve supplies hot water from the external water source to the detergent box 133. The bleach valve supplies wash water to the bleaching agent receiving unit of the detergent box 133. The pre-action valve, which is used at an initial stage of a washing cycle, supplies wash water to the drum 124 through the detergent box 133. The wash water introduced through the pre-action valve is supplied into the drum 124 without being mixed with the detergent in the detergent box 133.

During the washing cycle, the main valve supplies wash water to the detergent box 133 after the supply of the wash water through the pre-action valve is completed. The wash water supplied through the main valve passes through the washing detergent receiving unit of the detergent box 133 and is then supplied into the drum together with the washing detergent. The steam valve supplies wash water to a steam hose (not shown) connected to a steam module (not shown).

During a final rinsing cycle, in which fabric softener is supplied, the main valve and the pre-action valve are simultaneously driven for supplying wash water to the fabric softener receiving unit of the detergent box 133. During a normal rinsing cycle, in which laundry is rinsed using washing detergent, the bleach valve, the main valve, and the pre-action valve are driven for supplying wash water into the drum 124. As described above, the respective valves perform their own functions.

According to embodiments, two or more of the valves may be combined for performing their own functions. In addition, any one of the valves may function as the first water supply valve 131*a*, and any one of the hoses connected to the detergent box 133 through the respective valves may function as the first water supply hose 132.

The first water supply hose 132 is connected between the first water supply valve 131*a* and the detergent box 133. Wash water flowing through the first water supply valve 131*a* reaches the detergent box 133 via the first water supply hose 132. The wash water, mixed with the detergent in the detergent box 133, is introduced into the drum 124 via the water supply pipe 134.

The second water supply hose 149 is directly connected between the second water supply valve 131*b* and the spray nozzle 140. Wash water supplied to the second water supply valve 131*b* from the external water source reaches the spray nozzle 140 via the second water supply hose 149. The wash water reaching the spray nozzle 140 is atomized into liquid drops or particles through the spray nozzle 140, and the atomized wash water is sprayed into the drum 124.

The spray nozzle 140 sprays the wash water to the inside surface 124*a* and the rear surface 124*b* of the drum 124. The wash water sprayed from the spray nozzle 140 reaches the inside surface 124*a* of the drum 124, which corresponds to a circumferential surface of the drum 124, and the rear surface 124*b* of the drum 124, which corresponds to a bottom surface of the drum 124. When laundry is received in the drum 124, the laundry is generally placed at edges of the inside surface 124*a* and the rear surface 124*b* of the drum 124. The wash water is sprayed to the edges of the inside surface 124*a* and the rear surface 124*b* of the drum 124 such that the wash water acts on the laundry. Since the wash water sufficiently acts on the laundry by the spray nozzle 140, washing efficiency is improved.

In a rinsing cycle, in which the drum 124 is continuously rotated, the wash water uniformly acts on the laundry, and the wash water permeates the laundry due to centrifugal force. This is defined as a permeation washing effect. During continuous rotation of the drum 124, the spray nozzle 140 sprays the wash water, thereby achieving the permeation washing effect.

The components of the laundry treatment apparatus 100 as described above may be controlled by the controller 161 as shown in FIG. 3. Although FIG. 3 shows only some of the components of the laundry treatment apparatus 100, the controller 161 controls overall operation of the laundry treatment apparatus 100. Consequently, the controller 161 may control the other components of the laundry treatment apparatus 100, and it should be understood that these components are controlled by the controller 161 unless otherwise mentioned.

A laundry weight sensing module or component 162 is provided to sense the weight of laundry 10 placed in the drum 124. The laundry weight sensing unit 162 senses the weight of the laundry using a principle that inertia of the drum 124 is changed during rotation of the drum 124 depending upon load. For example, when the drum 124 is rotated in a state in which the drum 124 is stationary, the laundry is lifted within a predetermined section. At this time, the larger the laundry weight, the inertia in rest is higher. For this reason, it may be necessary to supply a larger amount of current so as to control the drum to be rotated at a predetermined speed.

Consequently, the laundry weight sensing unit 162 may decide the weight of the laundry based on the size of a current value supplied to the drive unit 113 within the predetermined section, in which the laundry is lifted during rotation of the drum 124. However, the present disclosure is not limited thereto. Various laundry weight sensing methods are well known in the field related to the laundry treatment apparatus. Laundry weight sensing at step S30, which will hereinafter be described, may be performed using various well-known laundry weight sensing methods.

Figure 5:
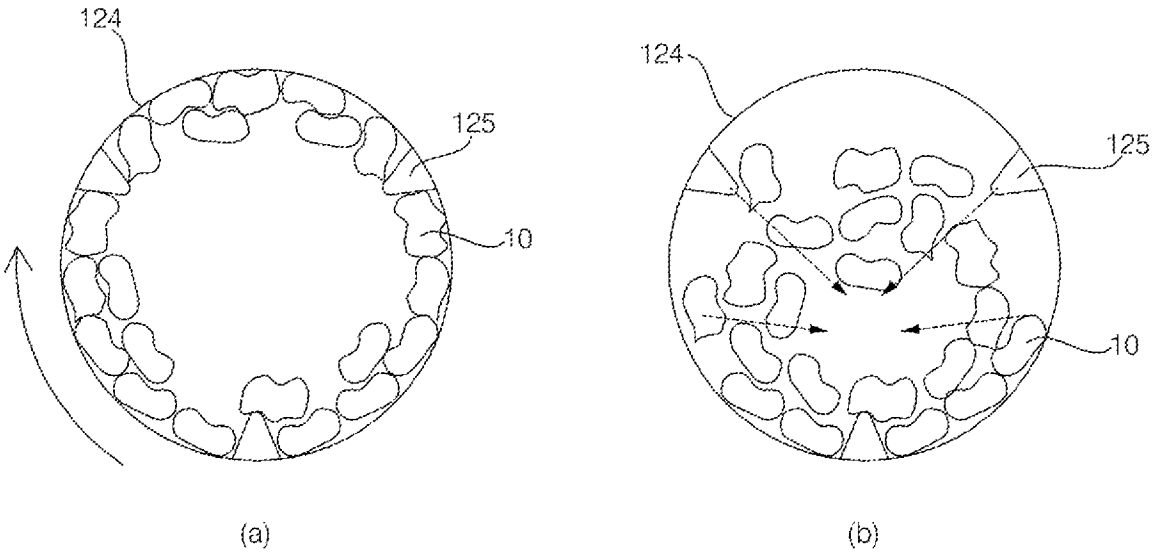
FIG. 5 is a view showing a squeezing motion.

FIG. 5 is a view showing a squeezing motion. In the washing method according to the embodiment of the present disclosure, the squeezing motion is a motion for accelerating the drum 124 at a high speed in a washing cycle or a rinsing cycle such that the laundry 10 is moved in a state in which the laundry 10 clings to the inside of the drum 124 and decelerating the drum 124 such that the laundry is separated from the inside of the drum 124, which are repeated at short intervals.

When the drum 124 is rotated at a high speed, the laundry 10 is moved in a state in which the laundry 10 clings to the inside of the drum 124 as shown in FIG. 5(*a*). For example, when the drum 124 is rotated at a speed of about 100 RPM, the laundry 10 is moved integrally with the drum 124 in a state in which the laundry tightly clings to an inner circumferential surface of the drum 124 due to centrifugal force. The drum 124 may be rotated at an appropriate speed for an appropriate time such that the laundry 10 can be rotated in a state in which the laundry 10 uniformly clings to the inside of the drum 124.

At this time, wash water may be uniformly sprayed to the laundry through at least one of the spray nozzle 140 or the circulation nozzle 127 (a laundry wetting step). The wash water sprayed through the nozzles 140 and/or 127 during execution of the squeezing motion at the laundry wetting step may be the wash water supplied from the external water source via the first water supply hose 132 or the wash water circulating via the circulation channel 137.

When the drum 124 is decelerated, the laundry 10 is separated from the inside of the drum 124 as shown in FIG. 5(*b*). The drum 124 is decelerated to a speed at which centrifugal force is not sufficiently applied to the laundry 10. As a result, the laundry 10 is separated from the inside of the drum 124 and falls due to gravity. The falling laundry is uniformly mixed with each other in the drum 124 due to rotation of the drum 124. At this time, wash water may be uniformly sprayed to the laundry 10 through the spray nozzle 140 and/or the circulation nozzle 127 in the same manner.

Acceleration and deceleration of the drum 124 may be repeated such that the process in which the laundry 10 clings to the inside of the drum 124 and is then separated from the inside of the drum 124 can be repeatedly performed. Acceleration and deceleration of the drum 124 may be repeated at short intervals. For example, acceleration and deceleration of the drum 124 may be repeated at short intervals of 1 to 4 seconds.

During acceleration and deceleration of the drum 124, the drum 124 may be continuously rotated. For example, the drum 124 may be accelerated from 50 RPM to 100 RPM. Acceleration of the drum 124 may be performed within 2 seconds. Specifically, acceleration of the drum 124 may be performed for about 1.2 seconds.

On the other hand, for example, the drum 124 may be decelerated from 100 RPM to 50 RPM. Deceleration of the drum 124 may be performed within 1 second. Specifically, acceleration of the drum 124 may be performed for about 0.5 seconds. In addition, various motions may be applied the laundry 10 based on the rotational type of the drum 124 in the laundry treatment apparatus 100. Other different motions will be described with reference to FIG. 6.

Figure 6:
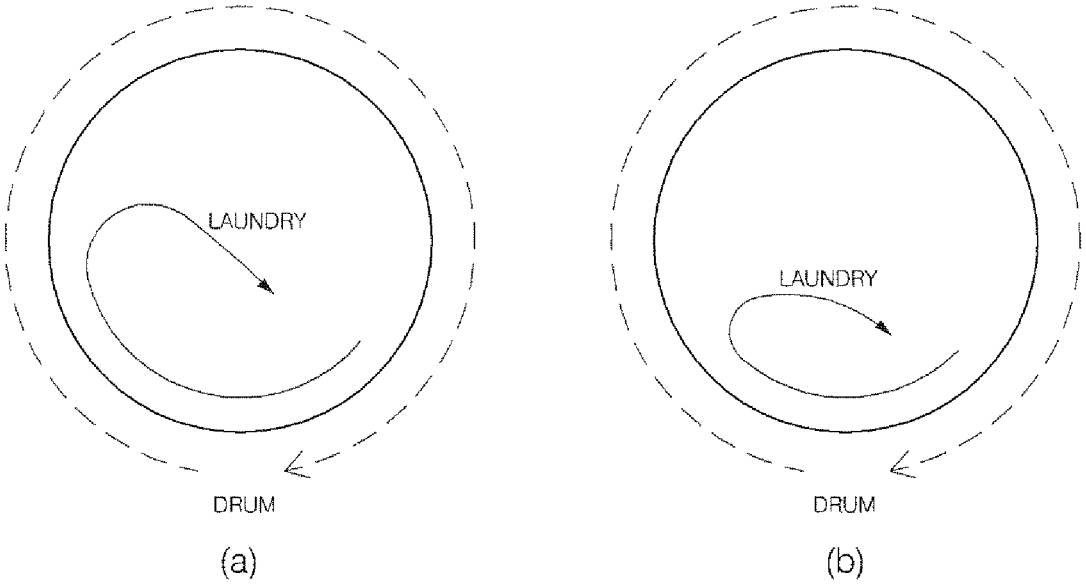
FIG. 6 is a view showing a tumbling motion (a) and a rolling motion (b)

FIG. 6(*a*) is a view showing a motion of the drive unit 113 rotating the drum 124 in a predetermined direction such that the laundry is lifted from the lowest position of the drum 124 and then falls from about the half the height of the drum 124 (hereinafter, referred to as a "tumbling motion"). In the tumbling motion, the drum 124 is continuously rotated at about 45 RPM, and the laundry in the drum 124 is washed by impact force and frictional force. In the tumbling motion, the drum 124 may be rotated in alternating directions.

FIG. 6(*b*) is a view showing a motion of the drive unit 113 continuously rotating the drum 124 in one direction such that the laundry is lifted to a predetermined height of the drum 124 from the lowest position of the drum 124 and then falls (hereinafter, referred to as a "rolling motion"). For example, in the rolling motion, the laundry may fall from lower than the half the height of the drum 124. At this time, the drum 124 is rotated at about 40 RPM or less. The laundry in the drum 124 falls as if the laundry rolls such that the laundry is washed by bending and stretching force and frictional force.

Figure 7:
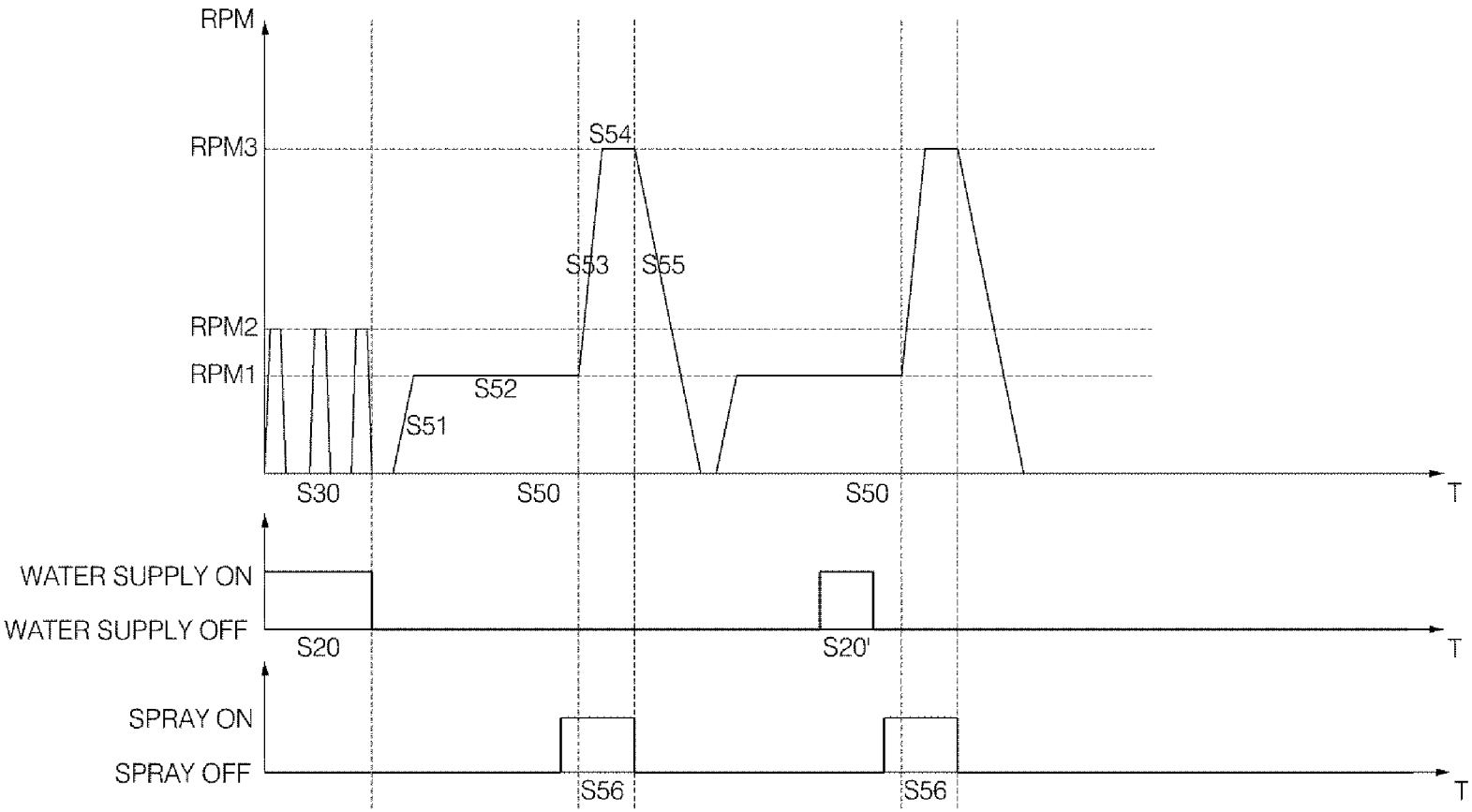
FIG. 7 is a graph showing a process of controlling a rotational speed of a drum (a), water supply (b), and spray (c) in a washing method according to an embodiment of the present disclosure.
Figure 8:
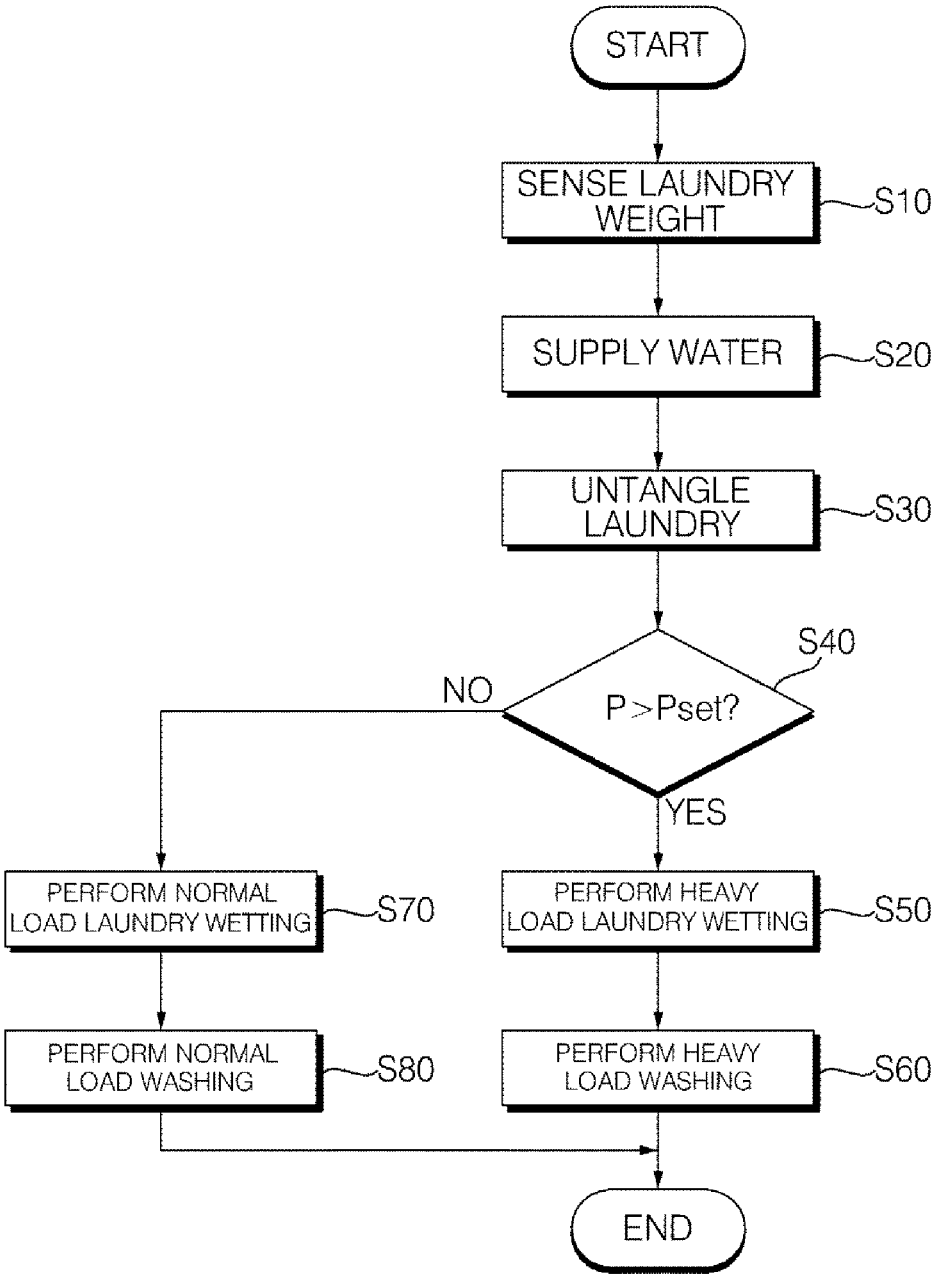
FIG. 8 is a flowchart showing the washing method according to the embodiment of the present disclosure.
Figure 9:
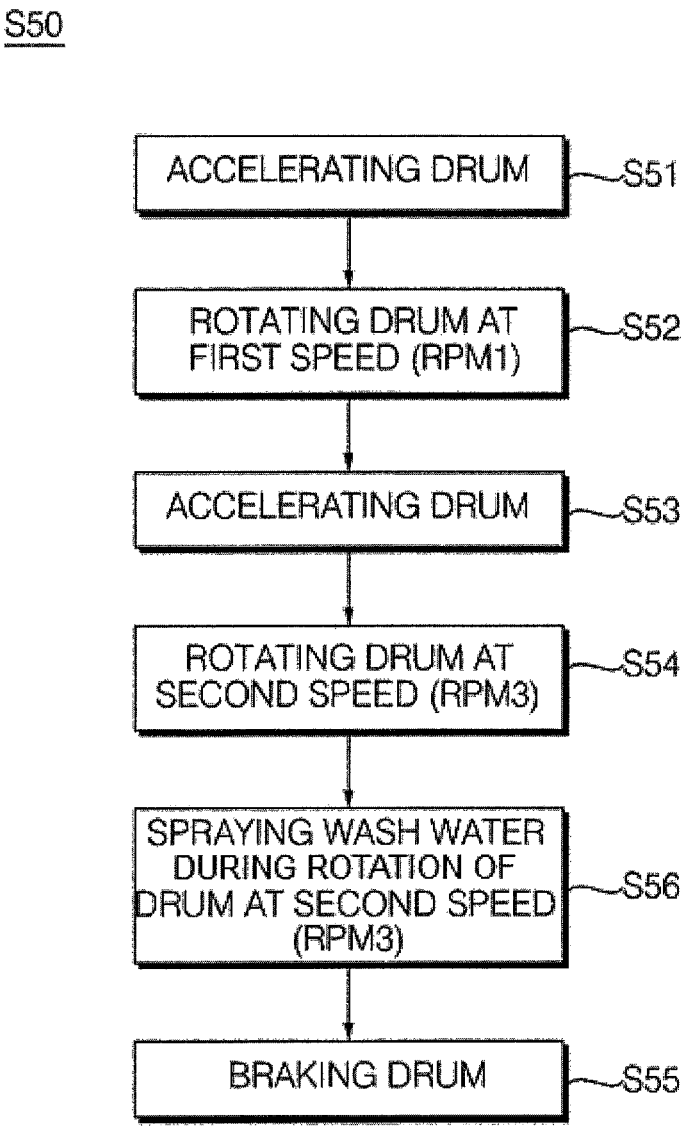
FIG. 9 is a flowchart showing the step of S50 in FIG. 8

FIG. 7 is a graph showing a process of controlling a rotational speed of a drum (a), water supply (b), and spry (c) in a washing method according to an embodiment of the present disclosure. FIG. 8 is a flowchart showing the washing method according to the embodiment of the present disclosure. FIG. 9 is a flowchart showing the step of S50 in FIG. 8

Referring to FIGS. 7 to 9, the washing method according to the embodiment of the present disclosure may include steps of S51, S52, S53, S54, S55 and S56. In S51, the drum 124 is accelerated. After the rotation of the drum 124 reaches a first speed (RPM1), drum 124 rotates in one direction at the first speed (RPM1) such that laundry is lifted to a predetermined height and then falls (S52).

After the rotation of the drum 124 at the first speed (RPM1), S53 of accelerating the drum 124 from the first speed (RPM1) to a second speed (RPM3) is performed. During the rotation of the drum 124 at the second speed (RPM3), at least some of the laundry clings to a side of the drum 124 for a full rotation of the drum 124. That is, at least some of the laundry is pressed onto an inner circumferential surface of the drum 124 and rotates together with the drum 124, even at the upper most position while the drum 124 rotates at the second speed (RPM 3). During the rotation of the drum 124 at the second speed (RPM3), wash water may be sprayed into the drum 124 (S56). After then, the rotation of the drum 124 may be braked (S55).

These steps (S51, S52, S53, S54, S55, S56) constitute a laundry wetting step (S50) at which the laundry is uniformly wetted by wash water having detergent dissolved therein (hereinafter, referred to as detergent water) at an initial stage of a washing cycle. The laundry wetting step (S50) may be repeatedly carried out a plurality of times. However, while the wetting step (S50) being repeated, the detergent is not dissolve anymore, because the detergent box 133 is emptied after the first wetting step (S50).

The laundry wetting step (S50) may be carried out in a state in which the detergent water is received in the tub 122. At the laundry wetting step (S50), the laundry may be at least partially soaked in the detergent water. To this end, a water supply step (S20) may be carried out before the laundry wetting step (S50). At the water supply step (S20), the first water supply valve 131*a* is open, and water is supplied into the tub 122 such that at least a portion of the drum 124 can be soaked in the supplied water. In addition, a laundry weight sensing step (S10), a water supply step (S20), and/or a laundry untangling step (S30) may be carried out before the laundry wetting step (S50).

The laundry weight sensing step (S10) may be carried out before water is supplied, and the weight of the laundry may be sensed by the laundry weight sensing unit 162. At the water supply step (S20), the detergent water is supplied into the tub 122. The amount of wash water supplied through the first water supply valve 131*a* or the water level of the tub 122 may be set based on the weight of the laundry sensed at the laundry weight sensing step (S10). For example, as the weight of the laundry sensed at the laundry weight sensing step (S10) is higher, a larger amount of wash water may be supplied into the tub 122.

After the water supply step (S20), the laundry untangling step (S30) may be carried out. At the laundry untangling step (S30), the drum 124 is rotated in alternating directions such that the laundry can be uniformly distributed in the drum 124. For example, a tumbling motion is performed. At this time, the drum 124 may be rotated at a rotational speed (RPM2) higher than the first speed (RPM1) and lower than the second speed (RPM3).

At the laundry wetting step (S50), wash water is sprayed into the drum 124 in at least one section during rotation of the drum 124 at the second speed (RPM3). For example, the wash water may be sprayed through the spray nozzle 140. According to embodiments, the wash water may be sprayed through the circulation nozzle 127.

In the section (S54) in which the drum 124 is rotated at the second speed (RPM3), the above-mentioned squeezing motion (see FIG. 5) may be performed. The squeezing motion may be performed in different fashions depending upon the weight of the laundry placed in the drum 124 although the drum 124 is rotated at the same speed. For example, in a case in which the weight P of the laundry placed in the drum 124 is less than a reference value Pset, substantially entire laundry is clings to the drum 124 for a full rotation of the drum 124. On the other hand, in a case in which the weight P of the laundry is equal to or greater than the reference value Pset, the drum 124 is filled with the laundry in a state in which there is no empty space in the drum 124 as compared with the case in which the weight P of the laundry is less than the reference value Pset.

Consequently, the distances from the rotational center of the drum 124 to each laundry items show a meaningful deviation according to positions of the laundry items. That is, sufficiently high centrifugal force is applied the laundry adjacent to an inner circumferential surface of the drum 124 such that the laundry can cling to the drum 124 for a full rotation of the drum 124, since the distance between the laundry and the rotational center of the drum 124 is great. On the other hand, relatively low centrifugal force is applied the laundry adjacent to the rotational center of the drum 124 with the result that the laundry cannot cling to the drum 124.

In a state in which a large amount of laundry is placed in the drum 124, therefore, the detergent water in the tub 122 may not be absorbed by the laundry adjacent to the rotational center of the drum 124 only through rotation of the drum 124. At step S56 of this embodiment, wash water is sprayed into the drum 124 during rotation of the drum 124 at the second speed (RPM3) such that the laundry adjacent to the rotational center of the drum 124 as well as the laundry clinging to the drum 124 can be wetted by the wash water. In particular, the wash water sprayed from the spray nozzle 140 or the circulation nozzle 127 is directly applied to the laundry, thereby improving washing performance based on spray pressure and uniform permeation of the detergent into the laundry.

Meanwhile, step S56 is not necessary to be carried out only during rotation of the drum 124 at the second speed (RPM3). For example, as shown in FIG. 7, step S56 may be initiated while the drum 124 rotates at the first speed (RPM1).

During rotation of the drum 124 at the second speed (RPM3), the drum 124 may be braked (S55). After the drum 124 is braked and then stopped, the laundry wetting step (S50) may be carried out again.

According to embodiments, a heater for heating the wash water in the tub 122 may be further provided. In this case, the wash water may be heated by the heater after the laundry wetting step (S50) is completed.

In addition, additional water supply (S20') may be performed during execution of the laundry wetting step (S50). At the time of the additional water supply (S20'), at least one of the first water supply valve 131*a* and the second water supply valve 131*b* may be open. During execution of the laundry wetting step (S50), the wash water is absorbed by the laundry with the result that the water level of the tub 122 is lowered. The lowered water level of the tub 122 may be compensated for by performing the additional water supply (S20').

The additional water supply (S20') may be performed depending upon a degree of reduction in water level of the tub 122. For example, in a case in which the water level of the tub 122 is lowered to an extent that the drum 124 cannot be soaked in the wash water during execution of the laundry wetting step (S50), the additional water supply (S20') may be performed.

Since the squeezing motion takes different aspect in terms of laundry movement, according to the weight of the laundry as described above, the laundry wetting step (S50) is carried out in a case in which the weight P of the laundry sensed at the laundry weight sensing step (S10) is equal to or greater than the reference value Pset in this embodiment ('YES' of S40). This laundry wetting step (S50) is defined as a heavy load laundry wetting step.

After the heavy load laundry wetting step (S50), washing (S60) may be performed according to a predetermined washing, rinsing, or spin-drying pattern. This washing is defined as heavy load washing.

On the other hand, in a case in which it is determined at step S40 that the weight P of the laundry is less than the reference value Pset ('NO' of S40), a normal load laundry wetting step (S70) is carried out. At the normal load laundry wetting step (S70), the laundry may be wetted according to a pattern different than that of the heavy load laundry wetting step (S50). For example, at the normal load laundry wetting step (S70), the drum 124 is continuously rotated in one direction at the first speed (RPM1) such that the laundry is lifted to a predetermined height and then falls. At this time, wash water may be sprayed into the drum through at least one of the spray nozzle 140 and the circulation nozzle 127.

After the normal load laundry wetting step (S70), washing (S80) may be performed according to a predetermined washing, rinsing, or spin-drying pattern. At the normal load washing step (S80), the laundry may be washed according to a pattern different than that of the heavy load washing step (S60).

The present method may allow effective wetting or soaking of laundry. Particularly in a case in which a large amount of laundry is placed in the drum, it is possible to wet the laundry located at a central portion of the drum.

The present method may also improve washing performance based on the improved laundry wetting method.

It is possible to rotate the drum at a first speed such that the position of the laundry in the drum is changed, to accelerate the drum to a second speed such that the laundry uniformly clings to the inner circumferential surface of the drum, and to spray wash water into the drum such that the laundry located at the central portion of the drum as well as the laundry clinging to the inner circumferential surface of the drum can be wetted by the wash water, thereby effectively achieving wetting of the laundry over the entire region of the drum.

The present washing method is capable of wetting even laundry located at a central portion of a drum even in a case in which a large amount of laundry is placed in the drum.

The present washing method is capable of effectively permeating wash water into laundry to improve washing performance.

A washing method includes (a) continuously rotating a drum in one direction at a first speed such that laundry is lifted to a predetermined height and then falls, (b) accelerating the drum to rotate the drum at a second speed such that the laundry is moved in a state in which at least some of the laundry clings to the drum, and (c) spraying wash water into the drum during rotation of the drum at the second speed.

Step (a) may include rotating the drum such that the laundry is lifted from the lowest position of the drum and then falls from the predetermined height. Step (a) may include rotating the drum such that the laundry falls from lower than half the height of the drum. Step (c) may be carried out in a latter half of step (b). The washing method may further include braking the drum rotated at the second speed, wherein step (a), step (b), and step (c) may be repeated after the drum is braked.

Step (c) may include spraying wash water supplied from an external water source into the drum. Step (c) may include spraying wash water drained from the drum into the drum again.

The washing method may further include sensing weight of the laundry, wherein step (a), step (b), and step (c) may be carried out in a case in which the sensed weight of the laundry is equal to or greater than a predetermined reference value. On the other hand, step (a) may be carried out in a case in which the sensed weight of the laundry is less than the reference value, and wash water may be sprayed into the drum during execution of step (a).

The washing method may further include (d) rotating the drum in alternating directions, wherein step (b) may be carried out after step (d). Step (d) may include supplying wash water having detergent dissolved therein into a tub such that at least a portion of the drum is soaked in the wash water.

Step (a), step (b), and step (c) may be carried out in a state in which wash water having detergent dissolved therein is received in the tub and in a state in which at least a portion of the drum is soaked in the wash water in the tub.

At step (b), at least some of the laundry in the drum may cling to a side of the drum 124 for a full rotation of the drum 124 in a state when the rest of the laundry tumbles inside the drum 124.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for washing laundry comprising:

(a) sensing weight of the laundry; and (b) based on the sensed weight of the laundry, performing a first wetting of the laundry or a second wetting of the laundry, wherein the first wetting of the laundry is performed when the sensed weight of the laundry is equal to or greater than a predetermined reference value, the first wetting of the laundry comprising:

rotating a drum in a first direction at a first speed such that laundry is lifted to a predetermined height of the drum and falls below the predetermined height once the laundry reaches the predetermined height;

accelerating the drum from the first speed to a second speed to rotate the drum at the second speed such that at least some of the laundry clings to a side of the drum for a full rotation of the drum; and spraying wash water into the drum during rotation of the drum at the second speed, wherein the second wetting of the laundry is performed when the sensed weight of the laundry is less than the predetermined reference value, the second wetting of the laundry comprising:

rotating the drum in the first direction at the first speed such that laundry is lifted to the predetermined height of the drum and falls below the predetermined height once the laundry reaches the predetermined height; and spraying wash water into the drum during rotation of the drum at the first speed.

2. The method according to claim 1, wherein the rotating of the drum at the first speed comprises rotating the drum such that the laundry is lifted from a lowest position of the drum and then falls from the predetermined height of the drum.

3. The method according to claim 2, wherein the rotating of the drum at the first speed comprises rotating the drum such that the laundry falls from lower than half the height of the drum.

4. The method according to claim 1, wherein the spraying of the wash water into the drum during rotation of the drum at the second speed is carried out in a latter half of the accelerating of the drum.

5. The method according to claim 1, the first wetting of the laundry comprising:

braking the drum rotated at the second speed, wherein the rotating of the drum, the accelerating of the drum, and the spraying of the wash water in the first wetting of the laundry are repeated after the drum is braked.

6. The method according to claim 1, wherein the spraying of the wash water into the drum during rotation of the drum at the second speed comprises spraying wash water supplied from an external water source into the drum.

7. The method according to claim 1, wherein the spraying of the wash water into the drum during rotation of the drum at the second speed comprises spraying wash water recycled from the drum.

8. The method according to claim 1, further comprising:

changing of the rotation of the drum from the first direction to a second direction, which is opposite of the first direction and alternating a rotational direction of the drum between the first and second directions, wherein the accelerating of the drum is carried out after the changing of the rotation the drum from the first direction to the second direction.

9. The method according to claim 8, wherein the changing of the rotation of the drum from the first direction to the second direction comprises supplying wash water having detergent dissolved therein into a tub such that at least a portion of the drum is filled with the wash water.

10. The method according to claim 1, wherein the first wetting of the laundry is performed when wash water having detergent dissolved therein is provided into a tub and at least a portion of the drum is filled with the wash water.

11. The method according to claim 1, wherein another some of the laundry tumbles inside the drum in the accelerating of the drum from the first speed to the second speed.

12. A method for washing laundry comprising:

(a) sensing weight of the laundry; and (b) determining to perform a normal load laundry wetting or a heavy load laundry wetting based on the sensed weight of the laundry, wherein the normal load laundry wetting is performed according to the determination that the sensed weight of the laundry is less than a predetermined reference value, and the heavy load laundry wetting is performed according to the determination that the sensed weight of the laundry is equal to or greater than the predetermined reference value, wherein the normal load laundry wetting comprises:

rotating a drum in a first direction at a first speed such that laundry is lifted to a predetermined height of the drum and falls below the predetermined height once the laundry reaches the predetermined height; and spraying wash water into the drum during rotation of the drum at the first speed, wherein the heavy load laundry wetting comprises:

rotating the drum in the first direction at the first speed such that laundry is lifted to the predetermined height of the drum and falls below the predetermined height once the laundry reaches the predetermined height;

accelerating the drum from the first speed to a second speed to rotate the drum at the second speed such that at least some of the laundry clings to a side of the drum for a full rotation of the drum; and spraying wash water into the drum during rotation of the drum at the second speed.

* * * * *